United States Patent [19]

Netti

[11] 4,364,198

[45] Dec. 21, 1982

[54] STORM UNIT FOR EXISTING WINDOW

[76] Inventor: Thomas J. Netti, 3 Wallace Ave., Auburn, N.Y. 13021

[21] Appl. No.: 167,677

[22] Filed: Jul. 11, 1980

[51] Int. Cl.[3] ..... E05B 65/04

[52] U.S. Cl. ..... 49/62; 49/63; 49/413; 49/506

[58] Field of Search ..... 49/61, 62, 63, 413, 49/506

[56] References Cited

U.S. PATENT DOCUMENTS

| | | | |
|---|---|---|---|
| 2,602,501 | 7/1952 | Roos | 49/34 X |
| 3,065,507 | 11/1962 | Cloutier et al. | 49/63 |
| 3,222,734 | 12/1965 | Punt | 49/63 X |
| 3,861,081 | 1/1975 | Maskell | 49/63 X |
| 4,180,942 | 1/1980 | Sancier | 49/63 X |

*Primary Examiner*—Kenneth Downey

*Attorney, Agent, or Firm*—Bruns & Jenney

[57] ABSTRACT

A storm unit for installation in an existing window system to provide for greater insulation and weather protection. The unit includes a pair of side rails for replacing the existing inside stops of the window. The rails have a pair of parallel, vertically-extended grooves formed therein into which are buckled deformable, transparent panels whereby the panels can be raised and lowered. The top and bottom edge of each panel has a horizontally-extended cap secured thereto. When the panels are closed against the window frame, the bottom cap of the upper panel is horizontally aligned with the upper cap of the lower panel. A weathertight seal is provided that is capable of sealing the region between the adjacent faces of the two aligned caps when the panels are placed in a closed position.

16 Claims, 8 Drawing Figures

STORM UNIT FOR EXISTING WINDOW

BACKGROUND OF THE INVENTION

This invention relates to a storm unit and, in particular, to a storm unit that can be added to an existing window assemblage for providing added insulation and weatherproofing, or alternatively, allowing the window sashes to be opened for ventilation.

In many existing buildings, particularly older buildings, the windows are poorly fitted and generally lack sufficient storm protection to keep out the elements. Energy that is consumed in conditioning the air within the building, whether it be for cooling or heating purposes, is rapidly lost to the surrounding ambience through the window openings. This type of energy loss is not only costly but is also extremely wasteful during a period when all forms of energy are in short supply.

It has proven rather difficult to insulate and/or weatherproof existing window systems because the windows are oftentimes not of a standard size and/or shape and the frames can become misaligned or warped with age. Consequently, reconstructed or modular storm units are not practical for use in conjunction with existing windows. An internally-mounted storm window has been developed wherein channel-like strips are nailed or screwed to the inside molding of the window frame and a single sheet of flexible plastic is, in turn, secured to the channels to establish a generally-unitized, sealed enclosure over the existing window sash or sashes. Although this type of seal does furnish additional insulation and weatherproofing, it prevents the underlying sashes from being opened or cleaned. Furthermore, the exposed channels are generally unsightly and the screws and nails damage the molding.

SUMMARY OF THE INVENTION

It is therefore an object of the present invention to improve existing window systems.

A still further object of the present invention is to insulate existing window systems.

Another object of the present invention is to weatherproof existing window systems that might have become less than weathertight due to age or warpage.

Yet another object of the present invention is to provide a storm unit that can be added to an existing window assembly which is operable to allow the window sashes to be opened and closed for ventilation and cleaning.

Still another object of the present invention is to provide an add-on storm unit that can be aligned independently of the existing window system to which it is mounted.

And still another object of the present invention is to provide an interior storm unit that is fully compatible with an existing double-hung window system.

Yet a still further object of the present invention is to provide a storm unit that may be installed from the inside of an existing window system without damaging or otherwise detracting from the window structure.

These and other objects of the invention are attained by a storm unit having a pair of side rails for replacing the existing window stops, adjusting means for permitting the rails to be independently aligned within the window frame, a pair of storm panels formed of a deformable material that are buckled into guideways cut into the rails whereby the panels can move up and down within the frame and sealing means for rendering the panels weathertight when the panels are brought to fully closed position.

BRIEF DESCRIPTION OF THE DRAWINGS

For a better understanding of these and other objects of the present invention reference is had to the following detailed description of the invention which is to be read in conjunction with the accompanying drawings, wherein.

DESCRIPTION OF THE INVENTION

Figure 1:
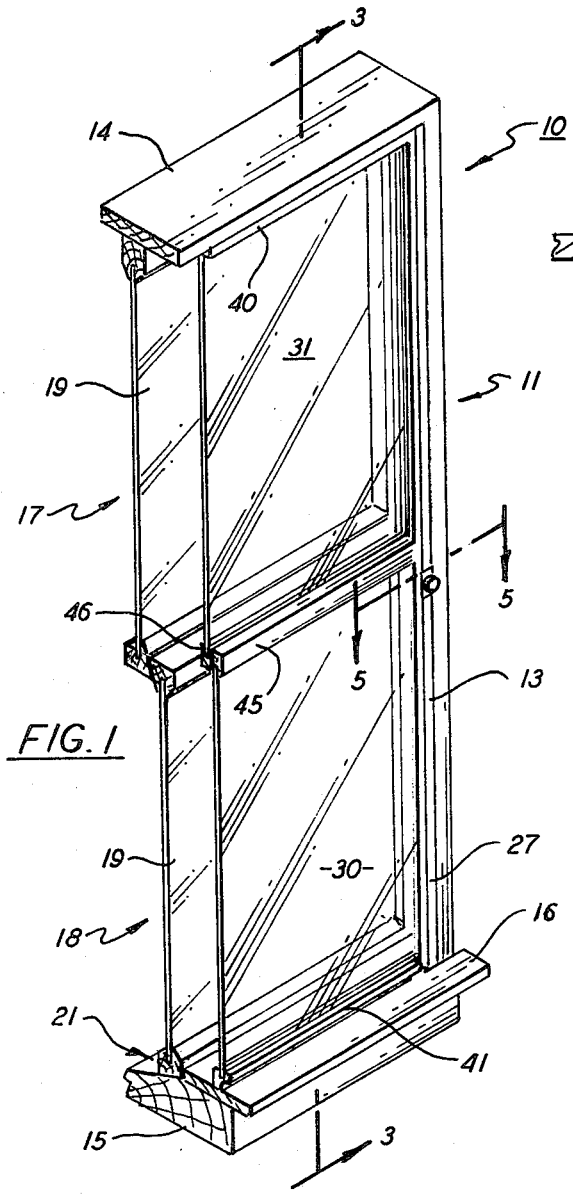
FIG. 1 is a partial perspective view of a window assembly having an internal storm unit embodying the teachings of the present invention.
Figure 2:
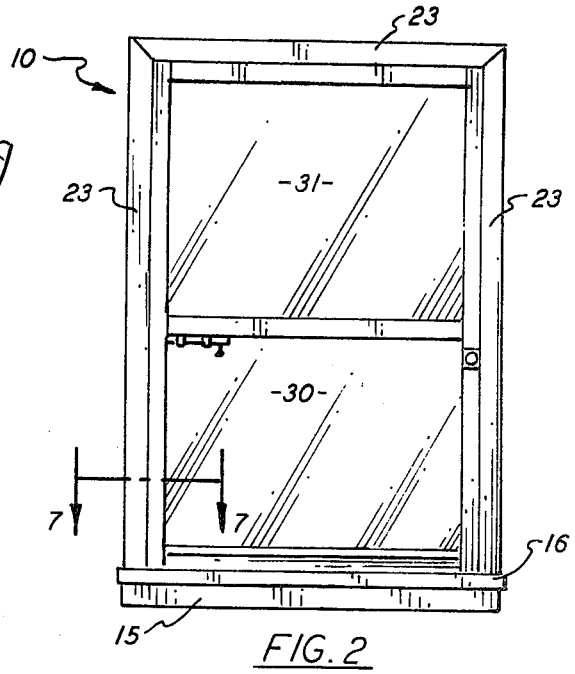
FIG. 2 is a side elevation of the window assembly shown in FIG. 1 as viewed from the inside of a building in which the window is mounted.

Referring initially to FIGS. 1 and 2, there is shown a double-hung window assembly, generally referenced 10, of the type typically found in older buildings. Although the present invention shall be explained with reference to a double-hung window, it should be evident to one skilled in the art that the invention is not necessarily limited to use in this particular structure and can be employed in association with any suitable type of window assembly. The assembly includes a window frame 11 that is made up of a pair of opposed, vertically-aligned, side jamb 13—13, a head jamb 14, and a bottom sill 15 upon which is secured a windowsill 16. An upper sash unit 17 and a lower sash unit 18 which are of similar construction, are slidably supported within the frame. Each sash unit contains a transparent light 19 with the light of the upper sash being mounted in rectanglar support 20 and the light of the lower sash being mounted in rectangular support 21. In assembly the exposed inside faces of the frames are covered with molding 23 to enhance the aesthetic value of the assembly and enclose the window within the wall of the building.

Figure 7:
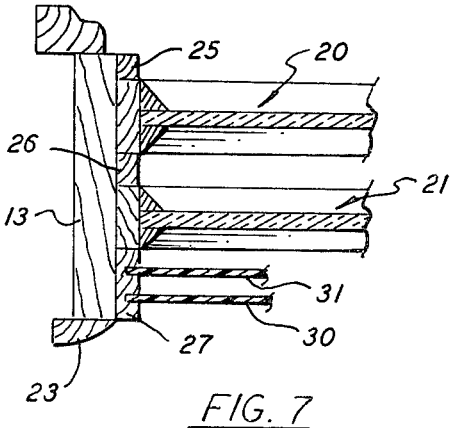
FIG. 7 is an enlarged section taken along lines 7—7 in FIG. 2 showing the arrangement of window sashes and storm panels within the window assembly.

With further reference to FIG. 7, each side of the upper sash support 20 is slidably mounted between an outer stop 25 and an intermediate stop 26. Each side of the lower sash support 21 is in turn slidably mounted between the noted intermediate stop 26 and one of the two inner rails 27. The two rails serve a twofold function of forming the inner stop for the window assembly and for providing a means by which a pair of storm panels 30 and 31 are contained within the assembly. The storm panels are each formed of a transparent, deformable material, preferably plastic, that has relatively good insulating properties and which also exhibits high resistance to breakage.

Figure 3:
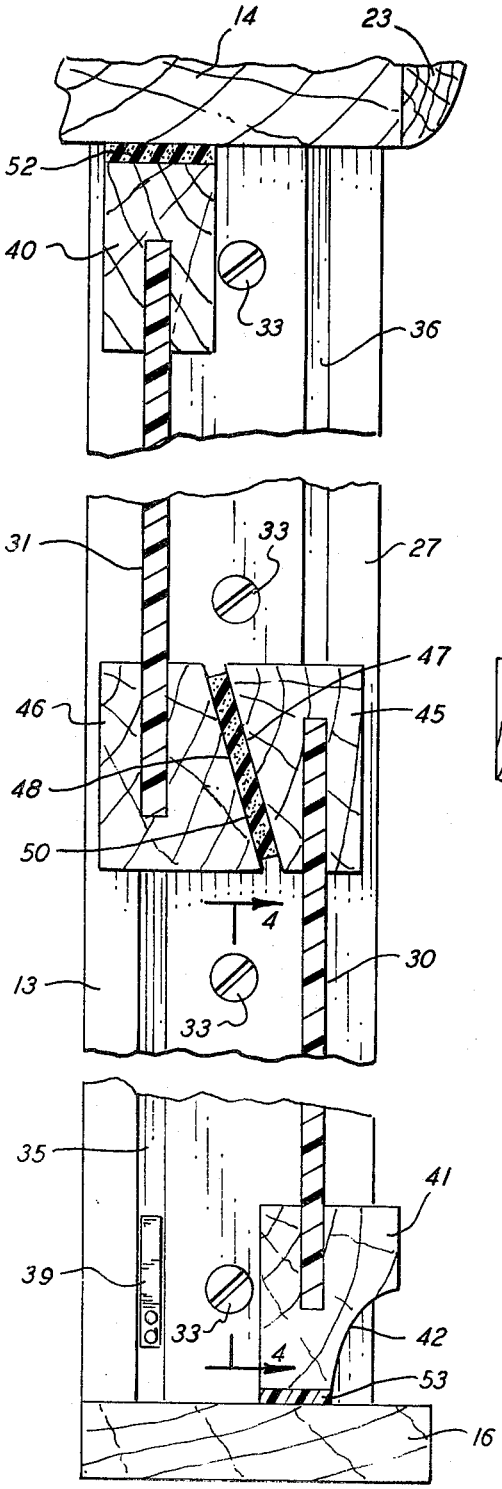
FIG. 3 is an enlarged section taken along lines 3—3 in FIG. 1 showing the storm panels slidably mounted in one of the side rails of the storm unit.

As illustrated in FIG. 3, the side rails 27—27 are each securely affixed to one of the side jambs of the window frame by means of a number of vertically-spaced, flat-headed wood screws 33—33. The screws are countersunk into the exposed end faces of the rails. A pair of parallel, square-shaped grooves 35 and 36 are cut into the end faces of the two rails with the grooves extending vertically along the entire length of the rail. The top storm panel 31 is slidably contained within the outer set of grooves 35—35 and the lower storm panel is slidably contained within the inner set of grooves 26—26. Each groove is precisely cut to furnish a close running fit with the side edge of a panel received therein whereby little or no air can pass around the side edges of the panels in assembly.

A soft biasing spring 39 is mounted in each of the grooves 35 and 36 about six inches above the window-stool 16. The action part of the spring extends into the groove a sufficient distance so that it will encounter the side edge of the panel that is slidably contained therein. The spring functions to exert a pressure against the panel which in practice will arrest the motion of the panel in the event it is inadvertently dropped while it is being repositioned.

The top edge margin of the upper storm panel is passed into a receiving groove formed in rectangular-shaped top cap 40 and the cap is glued to the panel to form an air-tight seal therebetween. A lower cap 41 is similarly glued along the bottom edge margin of the lower storm panel 30. The lower cap contains a recessed finger grip 42 for facilitating raising and lowering of the panel. A pair of cooperating center caps 45 and 46 are also glued to the opposite margins of the panels. When the two storm panels are closed against the window frame as illustrated in FIG. 3, the center caps are located in horizontal alignment along the mid-plane of the window frame.

The two adjacent faces 47 and 48 of the center caps are beveled to compliment each other as shown in FIG. 3. A weatherstrip 50 is secured to one of the adjacent faces, preferably the inner face 47, and extends across the length of the cap to fill the space between the caps and thus serves as a weathertight seal when the panels are brought to a closed position. The outer end faces of end caps 40 and 41 are also provided with weatherstripping 52 and 53, respectively, to further enhance the sealing properties of the window.

Figure 4:
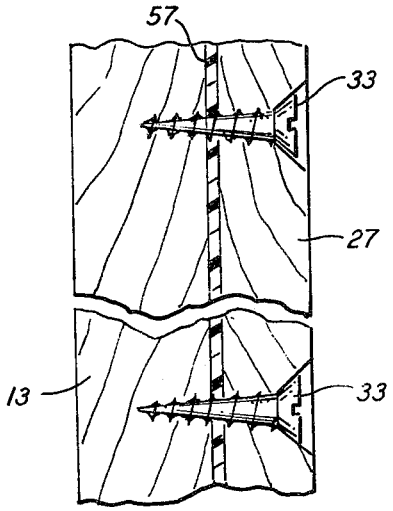
FIG. 4 is a partial section taken along lines 4—4 in FIG. 3 showing a deformable backing pad interposed between one of the rails and the side jamb of the window frame.

Turning now to FIG. 4, there is shown a section of the rail 27 which is secured to adjacent side jamb 13 by means of wood screws 33—33. The screws are countersunk below the surface of the rail end face to prevent the heads of the screws from interfering with the operation of the panels or from being entangled in the clothing of a person attempting to open or close the window sashes. A deformable rubber-like adjusting strip 57 is interposed between the rail and the jamb along the entire length of the rail. The screws 33—33 pass through the strip and hold it in place within the assembly. The adjusting strip provides a means by which the rails may be aligned independently within the frame. Alignment is accomplished by placing a bubble level against the end face of the rail and adjusting the holding pressure exerted by each screw to bring the end face of each rail into a vertical plane. By vertically aligning the two rails within the frame, the horizontal distance between the rails will be substantially uniform over the entire length of the rails. This, in turn, insures that the panels mounted within the rails will be able to slide freely within the plane defined by the guideways.

Figure 6:
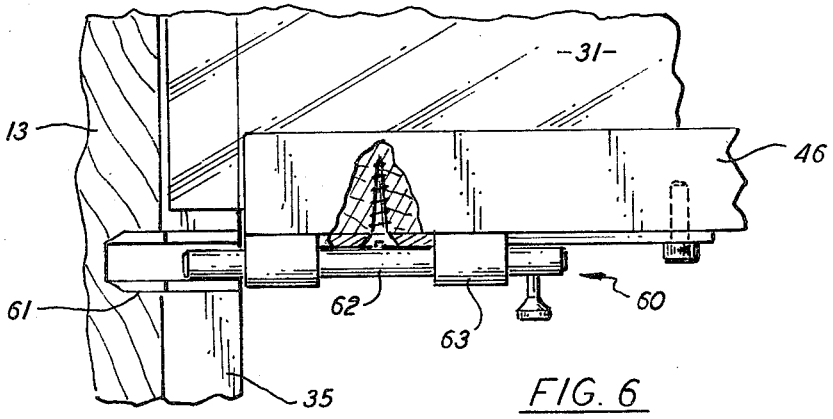
FIG. 6 is an enlarged top view in partial section of a locking mechanism for securing the top storm panels in a closed position against the head jamb of the window frame.

A bolt mechanism 60 is secured to the lower surface of cap 46. The bolt mechanism coacts with a keeper 61 to hold the top panel tight against the head jamb of the frame thereby creating an airtight seal therebetween. The bolt mechanism involves a sliding bolt 62 that is contained in a housing 63 which, in turn, is screwed to the lower surface of cap 46 as shown in FIG. 6. The keeper 61 is a sharpened cylinder that has an elongated slot 65 cut in one end thereof. In assembly, the keeper is driven into the rail and the slot is aligned with groove 35 so that the upper panel 31 can pass freely therethrough thereby allowing the panel to be raised and lowered.

Figure 5:
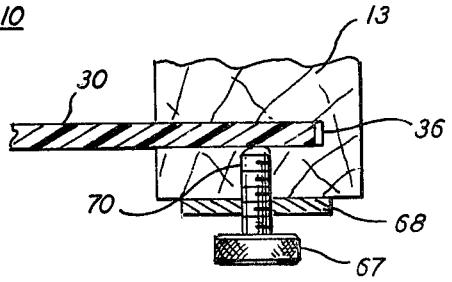
FIG. 5 is an enlarged section taken along lines 5—5 in FIG. 1 showing a friction stop for holding the lower panel of the storm unit at a selected elevation.

A thumb screw 67, as illustrated in FIGS. 2 and 5, is employed to hold the lower panel of the unit at a desired location. The thumb screw is threadably mounted in a metal plate 68 that is secured to one of the rails 13 by any suitable means. The shank 70 of the screw passes into the side of the rail via a hole provided and is able to act against the side margin of the panel 30 situated in the groove. In operation, the screw is tightened down to apply sufficient pressure against the panel to hold the panel immobile against the rail. As noted, the panel is preferably formed of a deformable plastic and consequently will not break or be seriously damaged under the holding action of the screw.

To assemble the storm unit in an existing window, the original inner stops, which slidably support the sash within the assembly, are removed from the frame and rails 27—27 are mounted in their place. As explained above, the rails are vertically aligned against the deformable strip to insure that a uniform spacing is maintained between rails. Care should be taken to see that the rails are snugly fitted between the head jamb and the stool of the window.

Figure 8:
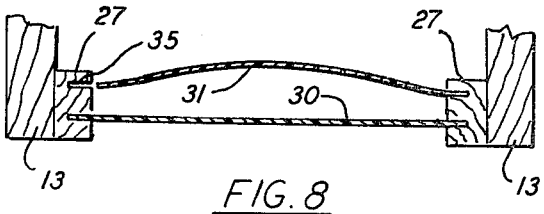
FIG. 8 is a top view in section showing one of the storm panels of the unit being buckled into the guideways contained within the rails.

With the rails in alignment, the panels are cut to a desired length that is about half the vertical length of the frame opening. The horizontal distance between the rails is measured and the panels cut to a width that is slightly more than the measured distance to allow the panel to pass into the grooves without bottoming against the back wall thereof. As illustrated in FIG. 8, the panels are mounted in the grooves by inserting one side of the panel into one of the grooves and then deforming the panel by buckling so that the other side of the panel can be snapped into the opposing or companion groove.

Once the panels are in place, the upper and lower caps are glued to the top and bottom panel edge margins. As previously noted, the caps are supplied with slots that are cut to a depth that permits the panels to be securely seated therein. In assembly, the caps are cut accurately to a length so that a minimum amount of clearance exists between the side edges of the cap and the end faces of the adjacent rails. The caps are glued to the panels using any suitable adhesive material that will fill the space between the panel and the cap to create a weatherproof seal. When the caps are in place and the glue in a semi-hardened state, the panels are brought to a closed position against the frame. Any variation in alignment between the frame and the contacting cap will be automatically adjusted as the still pliable glue allows the cap to shift its position to align itself against the frame. Accordingly, when the glue sets, the caps will be precisely seated against the frame despite any misalignment or warpage found therein.

Finally, the slide bolt and thumb screw mechanisms are installed and the exposed wood surface painted or stained as required.

As can be seen, the storm unit of the present invention permits the unit to be quickly and accurately installed in an existing window assembly without the need of special tools or the like. Once installed, the unit can be tightly closed against the window frame to establish a barrier of still air between the existing window sashes and the storm panels thereby dramatically increasing the insulation value of the window. By the same token, when the storm unit is closed, seals are established which prevent air from passing across the window boundaries. The storm panels contained in the unit also have the added feature of being able to be moved up and down thereby allowing the window sashes to be opened and thus provide natural ventilation to the building when desired.

While this invention has been described with reference to the details as set forth above, it is not limited to the specific structure as disclosed and the invention is intended to cover any modifications or changes as may come within the scope of the following claims.

I claim:

1. The method of assembling a storm unit in an existing window having at least one sash that is arranged to slide in a vertical direction within a frame, including the steps of removing the existing inside stops from the frame, installing vertical side rails in place of the stops against which the window slides, providing a pair of parallel grooves in the opposed end faces of the rails with the grooves extending along the vertical length of each rail to provide an inner set of opposed grooves and an outer set of opposed grooves, providing a pair of deformable flat transparent panels that are capable of being slidably mounted between the rails when seated in a flat posture within a set of said grooves, said panels having a total area which fills the window opening, buckling an upper panel into one of said set of grooves, buckling a lower panel into the other set of grooves, securing upper and lower caps to the upper and lower edges of the two panels, and weatherstripping between the lower cap of the upper panel and the upper cap of the lower panel to provide a seal when both panels are placed in a closed position filling the window opening.

2. The method of claim 1 further including the step of mounting weatherstripping along the frame contacting surface of both the upper cap of the upper panel and the lower cap of the lower panel to provide a seal between the frame and the said caps when the panels are placed in a closed position.

3. The method of claim 1 that further includes the step of horizontally aligning the rails so that the spacing between the rails is uniform along the vertical length of said rails.

4. The method of claim 3 that further includes the step of positioning deformable rubber-like strips between the rails and the side jambs of the frame to permit the rails to be aligned independent of the frame.

5. The method of claim 1 including the further step of providing a close running fit between the grooves and the panels positioned therein.

6. The method of claim 1 wherein said panels are formed of a clear plastic material having a high thermal resistance.

7. The method of claim 1 wherein said caps are secured to the panel by machining a lateral slot in one end face of the cap, inserting the edge of the panel into said slot and gluing the panel to the cap to create an airtight seal therebetween.

8. In a double-hung window having an inner sash and an outer sash that are arranged to slide over each other within a frame, the improvement comprising a pair of rails secured to the two opposing jambs of the frame adjacent to the inner sash whereby the rails serve as stops for guiding the inner sash as it is moved in the frame, each of said rails having a pair of parallel grooves extending along the entire length of the rail to establish a set of inner guideways and a set of outer guideways in the opposing side walls of the rails, means to independently align the rails between the jambs of the frame to align the guiderail sets within the frame, upper and lower deformable, flat, transparent storm panels having a total area that substantially fills the window opening and which are capable of being buckled into the guideways whereby each panel is slidably supported between a set of guideways, end caps secured to the edges of each panel that extend between the rails so that one end cap on a first panel is positioned adjacent another end cap on the second panel when the panels are closed against the frame to fill the frame opening, and sealing means secured to one of said adjacent end caps to provide a weathertight seal between said caps when the panels are closed against the frame.

9. The improvement of claim 8 wherein said rails are formed of wood and said panels are formed of plastic to provide a close sliding fit therebetween.

10. The improvement of claim 8 wherein said adjusting means includes a deformable rubber-like strip positioned between each rail and the opposed jambs of the frame against which the rail are adjustably seated.

11. The improvement of claim 10 further including a series of vertically-aligned, equally-spaced wood screws for securing each rail and the deformable strip to one of said jambs whereby varying pressure can be exerted against the strip along the length of the rail.

12. The improvement of claim 8 that further includes a bolt means for locking the upper panel in a closed position against the frame.

13. The improvement of claim 12 that further includes friction means for acting against said lower panel for holding said panel in a selected vertical position.

14. The improvement of claim 8 that further includes sealing means acting between the frame and the end caps of said panels for providing a seal between said caps and said frame when the panels are in a closed position.

15. The improvement of claim 8 wherein said end caps are secured to said panels by an adhesive to provide an airtight seal therebetween.

16. The improvement of claim 8 that further includes a biasing spring contained in each of the grooves having a spring means for engaging the panel mounted therein which is able to arrest the motion of said panel in the event the panel is dropped during the repositioning thereof.

* * * * *